US010898986B2

(12) United States Patent
Lee et al.

(10) Patent No.: US 10,898,986 B2
(45) Date of Patent: Jan. 26, 2021

(54) CHATTERING CORRECTION FOR ACCURATE SENSOR POSITION DETERMINATION ON WAFER

(71) Applicant: Applied Materials, Inc., Santa Clara, CA (US)

(72) Inventors: Harry Q. Lee, Los Altos, CA (US); Kun Xu, Sunol, CA (US); Jimin Zhang, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 158 days.

(21) Appl. No.: 16/122,682

(22) Filed: Sep. 5, 2018

(65) Prior Publication Data

US 2019/0084119 A1 Mar. 21, 2019

Related U.S. Application Data

(60) Provisional application No. 62/559,470, filed on Sep. 15, 2017.

(51) Int. Cl.
*G01B 5/02* (2006.01)
*B24B 37/013* (2012.01)
(Continued)

(52) U.S. Cl.
CPC ..... *B24B 37/013* (2013.01); *B24B 37/20* (2013.01); *B24B 49/105* (2013.01); *B24B 49/12* (2013.01)

(58) Field of Classification Search
CPC ... G01B 5/02; G01B 5/06; G01B 7/06; G01B 7/066; G01B 7/08; G01B 7/085;
(Continued)

(56) References Cited

U.S. PATENT DOCUMENTS 5,081,796 A 1/1992 Schultz
5,357,331 A 10/1994 Flockencier
(Continued)

FOREIGN PATENT DOCUMENTS

EP 0 663 265 7/1995
EP 0 738 561 10/1996
(Continued)

OTHER PUBLICATIONS

International Search Report and Written Opinion in International Application No. PCT/US2018/049730, dated Dec. 24, 2018, 16 pages.

*Primary Examiner* — Son T Le
(74) *Attorney, Agent, or Firm* — Fish & Richardson P.C.

(57) ABSTRACT

A method of controlling polishing includes sweeping a sensor of an in-situ monitoring system across a substrate as a layer of the substrate undergoes polishing, generating from the in-situ monitoring system a sequence of signal values that depend on a thickness of the layer, detecting from the sequence of signal values, a time that the sensor traverses a leading edge of the substrate or a retaining ring and a time that the sensor traverses a trailing edge of the substrate or retaining ring; and for each signal value of at least some of the sequence of signal values, determining a position on the substrate for the signal value based on the time that the sensor traverses the leading edge and the time that the sensor traverses a trailing edge.

22 Claims, 10 Drawing Sheets

(51) Int. Cl.
*B24B 49/12* (2006.01)
*B24B 49/10* (2006.01)
*B24B 37/20* (2012.01)

(58) Field of Classification Search
CPC ..... G01B 7/087; G01B 7/102; G01B 7/003; G01B 11/0683; B24B 37/013; B24B 37/20; B24B 49/10; B24B 49/105; B24B 49/12
See application file for complete search history.

(56) References Cited

U.S. PATENT DOCUMENTS 5,413,941 A 5/1995 Koos et al.
5,427,878 A 6/1995 Corliss
5,433,651 A 7/1995 Lustig et al.
5,605,760 A 2/1997 Roberts
5,609,511 A 3/1997 Moriyama et al.
5,640,242 A 6/1997 O'Boyle et al.
5,658,183 A 8/1997 Sandhu et al.
5,663,797 A 9/1997 Sandhu
5,672,091 A 9/1997 Takahashi et al.
5,708,506 A 1/1998 Birang
5,730,642 A 3/1998 Sandhu et al.
5,733,171 A 3/1998 Allen et al.
5,762,537 A 6/1998 Sandhu et al.
5,791,969 A 8/1998 Lund
5,838,447 A 11/1998 Hiyama et al.
5,851,135 A 12/1998 Sandhu et al.
5,865,666 A 2/1999 Nagahara
5,872,633 A 2/1999 Holzapfel et al.
5,893,796 A 4/1999 Birang et al.
5,899,792 A 5/1999 Yagi
5,949,927 A 9/1999 Tang
5,964,643 A 10/1999 Birang et al.
5,980,975 A 11/1999 Nomura et al.
6,004,187 A 12/1999 Nyui et al.
6,106,662 A 8/2000 Bibby et al.
6,159,073 A 12/2000 Wiswesser et al.
6,280,289 B1 8/2001 Wiswesser et al.
6,494,766 B1 12/2002 Wiswesser et al.
6,503,766 B1 1/2003 Ni
6,524,165 B1 2/2003 Wiswesser et al.
6,558,229 B2 5/2003 Kimura et al.
6,562,185 B2 5/2003 Avanzino et al.
6,621,264 B1 9/2003 Lehman et al.
6,633,831 B2 10/2003 Nikoonahad et al.
6,652,355 B2 11/2003 Wiswesser et al.
6,707,540 B1 3/2004 Lehman et al.
6,764,380 B2 7/2004 Wiswesser et al.
6,824,447 B2 11/2004 Takahashi et al.
6,913,511 B2 7/2005 Wiswesser et al.
6,923,711 B2 8/2005 Laursen et al.
7,018,271 B2 3/2006 Wiswesser et al.
7,097,537 B1 8/2006 David et al.
7,153,185 B1 12/2006 Birang et al.
2002/0047705 A1 4/2002 Tada et al.
2003/0104761 A1 6/2003 Wiswesser et al.
2004/0116047 A1 6/2004 Wiswesser et al.
2004/0242123 A1 12/2004 Wiswesser et al.
2005/0121141 A1* 6/2005 Manens ..... B24B 37/013 156/345.15
2007/0103150 A1 5/2007 Tada et al.
2014/0127971 A1* 5/2014 Xu ..... B24B 7/228 451/5
2015/0147940 A1 5/2015 Benvegnu et al.
2015/0314415 A1* 11/2015 David ..... B24B 49/12 451/6

FOREIGN PATENT DOCUMENTS

EP 0 881 040 12/1998
EP 0 881 484 12/1998
JP 3-234467 10/1991
WO WO 01/46684 6/2001

* cited by examiner

CHATTERING CORRECTION FOR ACCURATE SENSOR POSITION DETERMINATION ON WAFER

CROSS-REFERENCE TO RELATED APPLICATIONS

This application claims priority to U.S. Provisional Application Ser. No. 62/559,470, filed Sep. 15, 2017, the entire disclosure of which is incorporated by reference.

TECHNICAL FIELD

This disclosure relates to chemical mechanical polishing, and more particularly to methods and apparatuses for accurately determining the position of a measurement by an in-situ monitoring system on a substrate.

BACKGROUND

An integrated circuit is typically formed on a substrate by the sequential deposition of conductive, semiconductive, or insulative layers on a silicon wafer. One fabrication step involves depositing a filler layer over a non-planar surface, and planarizing the filler layer until the non-planar surface is exposed. For example, a conductive filler layer can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs, and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier head. The exposed surface of the substrate is placed against a rotating polishing disk pad or belt pad. The carrier head provides a controllable load on the substrate to push it against the polishing pad. A polishing liquid, such as a slurry with abrasive particles, is supplied to the surface of the polishing pad.

One problem in CMP is determining whether the polishing process is complete, i.e., whether a substrate layer has been planarized to a desired flatness or thickness, or when a desired amount of material has been removed. Over-polishing (removing too much) of a conductive layer or film leads to increased circuit resistance. On the other hand, under-polishing (removing too little) of a conductive layer leads to electrical shorting. Variations in the initial thickness of the substrate layer, the slurry composition, the polishing pad condition, the relative speed between the polishing pad and the substrate, and the load on the substrate can cause variations in the material removal rate. These variations cause variations in the time needed to reach the polishing endpoint. Therefore, the polishing endpoint cannot be determined merely as a function of polishing time.

More recently, in-situ monitoring of the substrate has been performed, e.g., with optical or eddy current sensors, in order to detect the polishing endpoint.

SUMMARY

This disclosure relates to chattering correction for accurate sensor position on a wafer.

In one aspect, a computer program product, tangibly encoded on a computer-readable media, includes instructions to cause a computer system to receive from a sensor of an in-situ monitoring system that sweeps across and monitors a substrate during polishing a sequence of signal values that depend on a thickness of a layer undergoing polishing on the substrate, detect from the sequence of signal values a time that the sensor traverses a leading edge of the substrate or a retaining ring holding the substrate and a time that the sensor traverses a trailing edge of the substrate or retaining ring, and for each signal value of at least some of the sequence of signal values determine a position on the substrate for the signal value based on the time that the sensor traverses the leading edge of the substrate or retaining ring and the time that the sensor traverses a trailing edge of the substrate or retaining ring.

In another aspect, a method of polishing includes bringing a surface of a layer of a substrate into contact with a polishing pad, causing relative motion between the substrate and the polishing pad, sweeping a sensor of an in-situ monitoring system across the substrate as the layer of the substrate undergoes polishing with a rotatable platen, generating from the in-situ monitoring system a sequence of signal values that depend on a thickness of the layer, detecting from the sequence of signal values a time that the sensor traverses a leading edge of the substrate or retaining ring and a time that the platen sensor traverses a trailing edge of the substrate or retaining ring, and for each signal value of at least some of the sequence of signal values determining a position on the substrate for the signal value based on the time that the platen sensor traverses the leading edge of the substrate or retaining ring and the time that the platen sensor traverses a trailing edge of the substrate or retaining ring.

In another aspect, a polishing system includes a rotatable platen to support a polishing pad, a carrier head to hold a substrate against the polishing pad, an in-situ monitoring system including a sensor to sweep across the substrate during polishing and generate a sequence of signal values that depend on a thickness of a layer undergoing polishing, and a controller. The controller is configured to receive the sequence of signal values from the sensor, detect from the sequence of signal values a time that the sensor traverses a leading edge of the substrate and a time that the sensor traverses a trailing edge of the substrate, and for each signal value of at least some of the sequence of signal values, determine a position on the substrate for the signal value based on the time that the sensor traverses the leading edge of the substrate or retaining ring and the time that the sensor traverses a trailing edge of the substrate or retaining ring.

Implementations may include one or more of the following features.

Determination of the position may include determination of a first derivative of the signal value, and identification of a first extra and a second extrema in the first derivative of the signal value. The first extrema is indicative of the leading edge and the second extrema is indicative of the trailing edge. A leading edge and a trailing edge of the retaining ring, e.g., a leading edge and a trailing edge of an inner surface of the retaining ring, can be detected. Detection of the sequence of signal values may include detection of a metallic layer within the leading edge and a trailing edge of the substrate.

A carrier head retaining the substrate may be positioned such that the center of the carrier head is the same radial distance from an axis of rotation of the rotatable platen as the platen sensor. The leading edge and the trailing edge of the substrate with may be detected the sensor. A time that the leading edge and the trailing edge cross the sensor may be determined. A platen rotation rate may be determined based on signals from a position sensor that is separate from the sensor of the in-situ monitoring system. A position of pin point on the edge may be determined. The position on the substrate may be calculated using the position of the pin point.

Determination of the position of the carrier head may include calculation of an angle θ subtended by the edge in accordance with $$\theta = \frac{t_{TE} - t_{LE}}{2}\omega$$

where $T_{LE}$ is the time that the sensor traverses the leading edge, $T_{TE}$ is the time that the sensor traverses the trailing edge, and ω is a rotation rate of the platen.

Determination of the position of the carrier head relative to the center of the platen, HS, may include calculation of the position of the carrier head in accordance with $$HS = \frac{-b \pm \sqrt{b^2 - 4ac}}{2a}$$

with $$a = 1$$

$$b = -2r_{sensor}\cos\theta,$$

$$c = r_{sensor}^2 - r_{pin}^2,$$

where $r_{sensor}$ is a distance of the sensor from the center of the platen.

Determination of the position on the substrate for the signal value, d, may include calculation of the position on the substrate in accordance with $$d^2 = HS^2 + r_{sensor}^2 - 2HSr_{sensor}\cos\gamma,$$

with $$\gamma = \left[t_{flash} - \frac{(t_{TE} - t_{LE})}{2}\right]\omega$$

where $t^{flash}$ is a time at which the measurement of the signal value made.

The in-situ monitoring system may include an eddy current sensor positioned in a recess of the platen, the eddy current sensor configured to generate a signal when a leading edge or a trailing edge of the substrate pass over the eddy current sensor, a drive and sense circuitry electrically coupled to the eddy current sensor and the controller, and a position sensor that is separate from the eddy current sensor, the position sensor configured to sense a position of the rotatable platen. The position sensor may include a radial encoder. The radial encoder may be coupled to a drive shaft of the rotatable platen.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 8A:
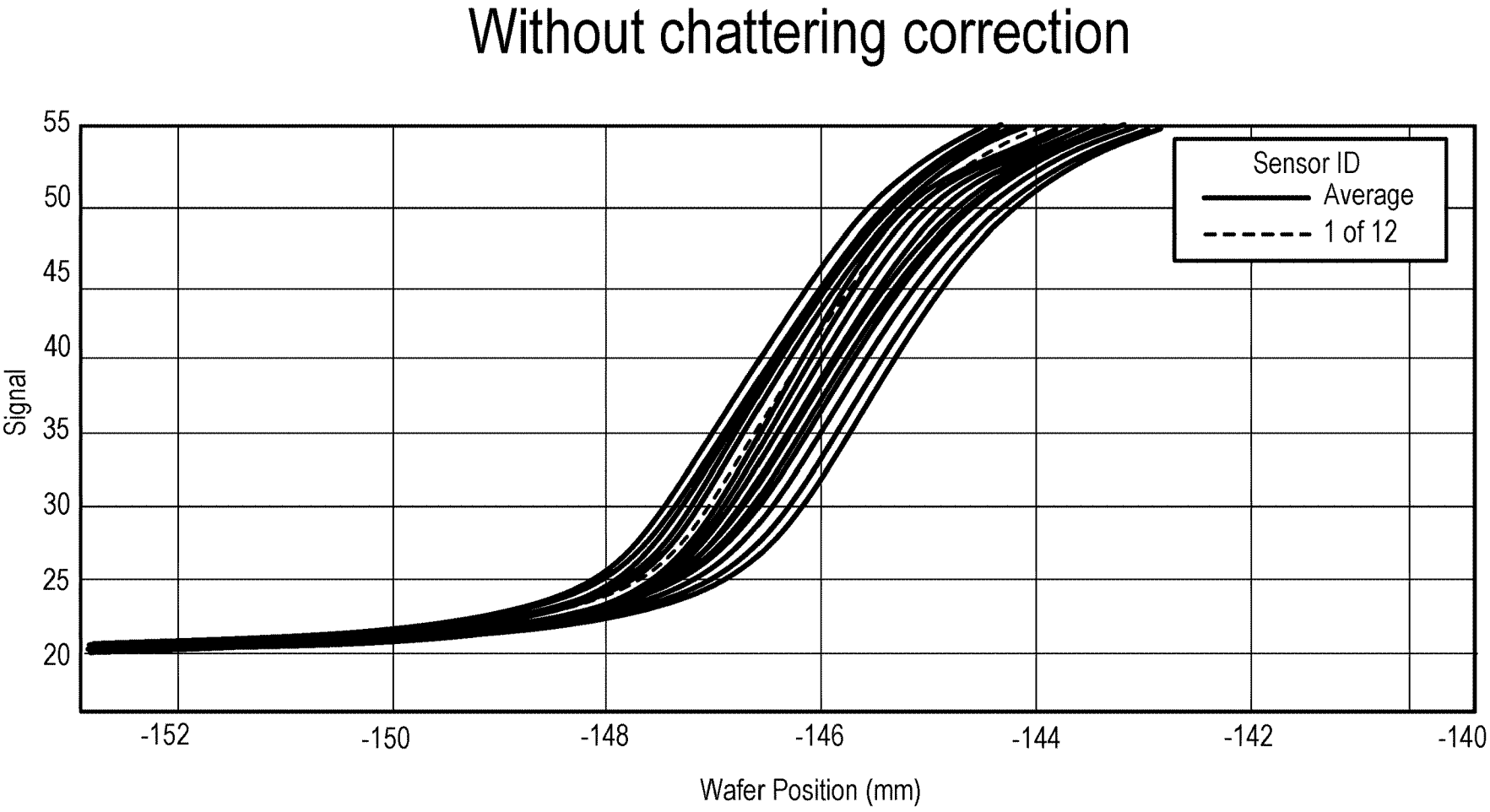
FIGS. 8A and 8B illustrate a plurality of traces (each trace is a signal from the eddy current monitoring system from a particular scan across the substrate) without and with the chattering correction, respectively. With the chattering correction, there is a more stable scan-to-scan trace. This permits a more accurate edge reconstruction.
Figure 8B:
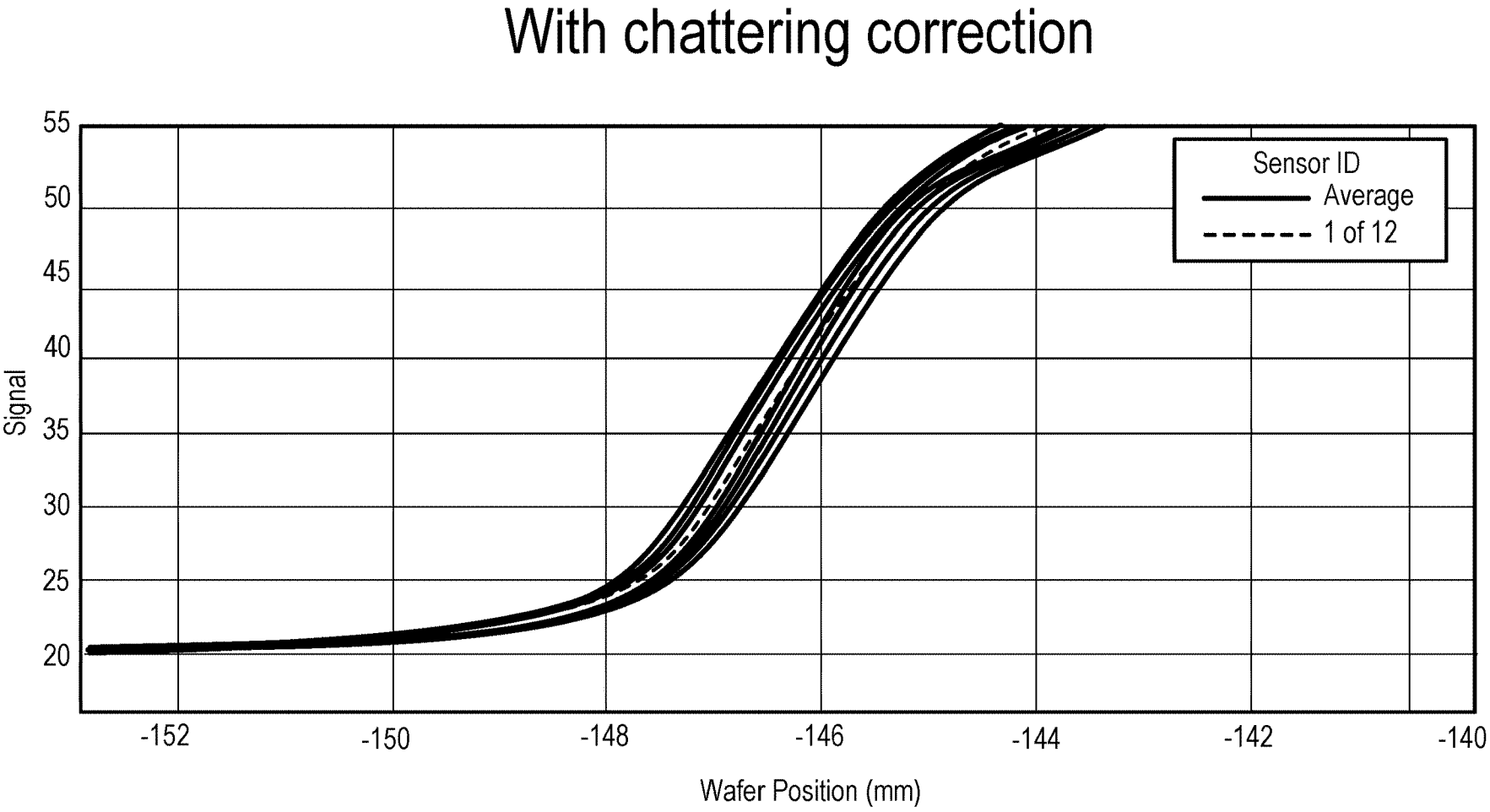

As noted above, in-situ monitoring of the substrate has been performed, e.g., with optical or eddy current sensors. If the sensor of the in-situ monitoring system scans across the substrate while making multiple measurements, it is often desirable to calculate the position (e.g., radial distance from the center of the substrate) of each individual measurement. One problem that can occur is "chattering"—inconsistent determination of the measurement positions from scan to scan—that causes both the leading and trailing edges of a trace shift forward and back in the time domain. This chattering exhibits as a back and forth left/right shifting when multiple traces are displayed (e.g., see FIG. 8A). The chattering can change with process platen/head rotation speed, or head sweep amplitude and frequency. In particular, chattering can become more severe at higher platen rotation rates and higher head sweep frequencies.

The chattering can create control instability, as the actual location of the sensor on the wafer is uncertain. As a result, edge reconstruction can be difficult, and can be dependent on process condition and thus not reliable. Without being limited to any particular theory, the root cause could come from several sources: the operator's information on head sweep location may be inaccurate, the platen and/or head rotation rate (e.g., in rpm) may not be accurate due to delay, and the spindle rotation may not be concentric, but may be wobbling.

In this new technique, a "pin location" is calibrated by running a substrate with no head sweep. The pin location can be detected from the retaining ring metal edge signal's first derivative, which is not dependent on film profile. Although the wafer edge can also be used, it is less desirable as the wafer edge location could change due to film edge exclusion. When this pin location is obtained, it is used to calculate real time head sweep and senses wafer location.

This technique can reduce chattering significantly and allow a more accurate determination of the position of the sensor on the substrate. It can also make edge reconstruction more reliable and less dependent on process conditions. The sensor position can be calculated using sensor measurements from the polisher rather than relying on process parameter information (e.g., platen rotation rate) sent from polisher.

Figure 1:
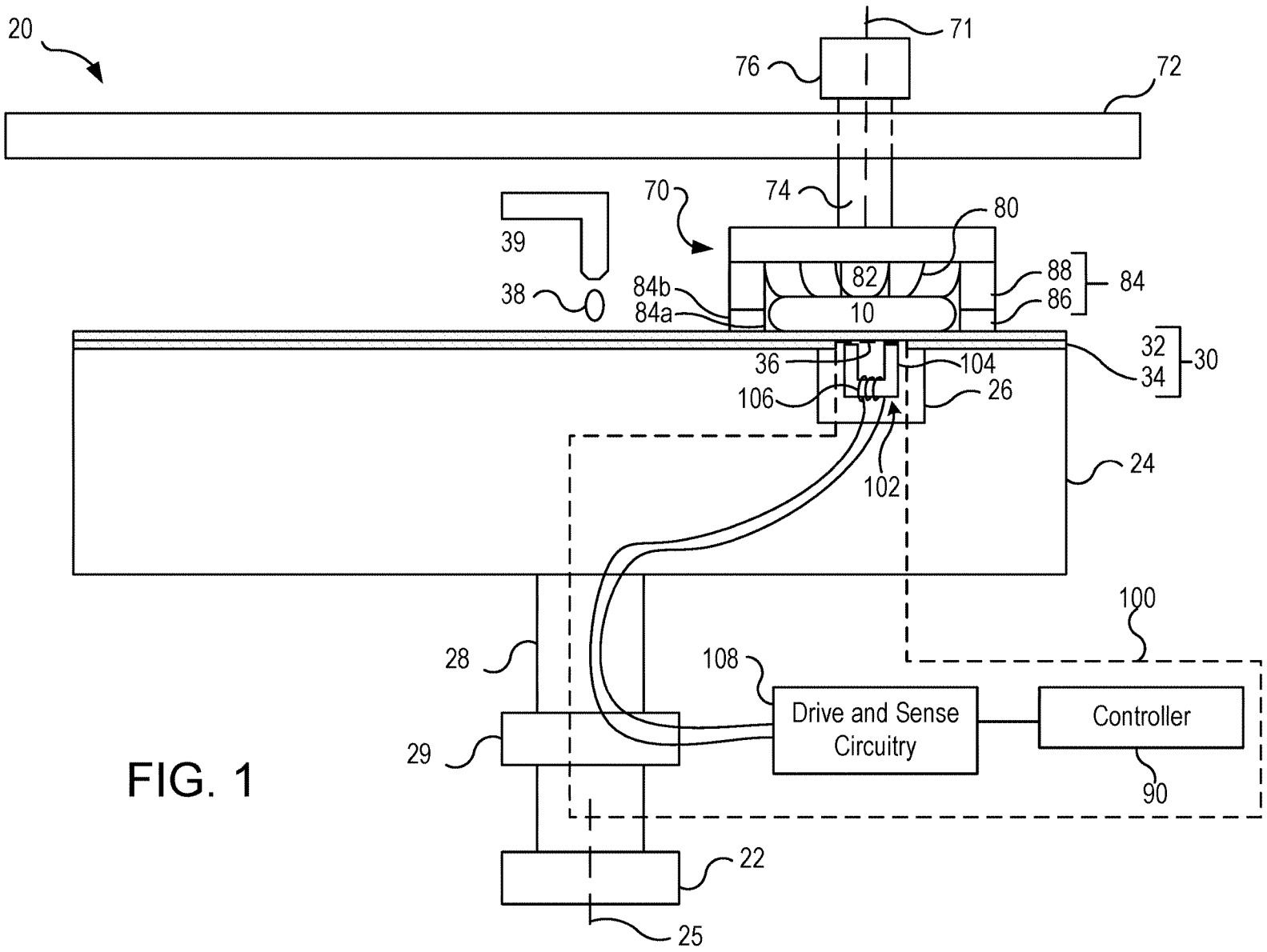
FIG. 1 is a schematic cross-sectional side view of a chemical mechanical polishing system.

FIG. 1 illustrates an example of a chemical mechanical polishing system 20. The polishing system includes a rotatable disk-shaped platen 24 on which a polishing pad 30 is situated. The platen 24 is operable to rotate about a first axis 25. For example, a motor 22 can turn a drive shaft 28 to rotate the platen 24. The polishing pad 30 can be a two-layer polishing pad with an outer polishing layer 34 and a softer backing layer 32.

The polishing system 20 can include a supply port or a combined supply-rinse arm 39 to dispense a polishing liquid 38, such as an abrasive slurry, onto the polishing pad 30. The polishing system 20 can include a pad conditioner apparatus with a conditioning disk to maintain the surface roughness of the polishing pad.

A carrier head 70 is operable to hold a substrate 10 against the polishing pad 30. The carrier head 70 is suspended from a support structure 72, e.g., a carousel or a track, and is connected by a drive shaft 74 to a carrier head rotation motor 76 so that the carrier head can rotate about a second axis 71. Optionally, the carrier head 70 can oscillate laterally, e.g., on sliders on the carousel, by movement along the track, or by rotational oscillation of the carousel itself.

The carrier head 70 can include a retaining ring 84 to hold the substrate. In some implementations, the retaining ring 84 may include a highly conductive portion, e.g., the carrier ring can include a thin lower plastic portion 86 that contacts the polishing pad, and a thick upper conductive portion 88. In some implementations, the highly conductive portion is a metal, e.g., the same metal as the layer being polished, such as copper.

The carrier head 70 can include a flexible membrane 80 having a substrate mounting surface to contact the back side of the substrate 10. The membrane 80 can form a plurality of pressurizable chambers 82 to apply different pressures to different zones, e.g., different radial zones, on the substrate 10.

In operation, the platen 24 is rotated about its central axis 25, and the carrier head 70 is rotated about its central axis 71 and translated laterally across the top surface of the polishing pad 30.

The polishing system 20 also includes an in-situ monitoring system 100, such as an eddy current monitoring system. The in-situ monitoring system 100 includes a sensor 102, e.g., a core and coil assembly to generate a magnetic field in the case of an eddy current monitoring system, to monitor the substrate 10 during polishing. The sensor 102 can be secured to the platen 24 such that the sensor 102 sweeps beneath the substrate 10 with each rotation of the platen 24. Each time the sensor 102 sweeps beneath the substrate, data can be collected from the in-situ monitoring system 100.

In operation, the polishing system can use the in-situ monitoring system 100 to determine when the conductive layer has reached a target thickness, e.g., a target depth for metal in a trench or a target thickness for a metal layer overlying the dielectric layer, and then halts polishing. Alternatively or in addition, the polishing system can use the in-situ monitoring system 100 to determine differences in thickness of the conductive material across the substrate 10, and use this information to adjust the pressure in one or more chambers 82 in the carrier head 70 during polishing in order to reduce polishing non-uniformity.

A recess 26 can be formed in the platen 24, and optionally, a thin pad section 36 can be formed in the polishing pad 30 overlying the recess 26. The recess 26 and thin pad section 36 can be positioned such that regardless of the translational position of the carrier head, they pass beneath substrate 10 during a portion of the platen rotation. Assuming that the polishing pad 30 is a two-layer pad, the thin pad section 36 can be constructed by removing a portion of the backing layer 32, and optionally forming a recess in the bottom of the polishing layer 34. The thin section can optionally be optically transmissive, e.g., if an in-situ optical monitoring system is integrated into the platen 24.

Assuming the in-situ monitoring system is an eddy current monitoring system, it can include a magnetic core 104, and at least one coil 106 wound around a portion of the core 104. The core 104 can be positioned at least partially in the recess 26. Drive and sense circuitry 108 is electrically connected to the coil 44. The drive and sense circuitry 108 generates a signal that can be sent to a controller 90, e.g., a programmed general purpose computer. Communication with the controller 90 can be provided by a wired connection through a rotary coupling 29 or by wireless communication. Although illustrated as outside the platen 24, some or all of the drive and sense circuitry 108 can be mounted in or on the platen 24, e.g., in the same recess 26 or a separate recess in the platen 24.

Figure 3:
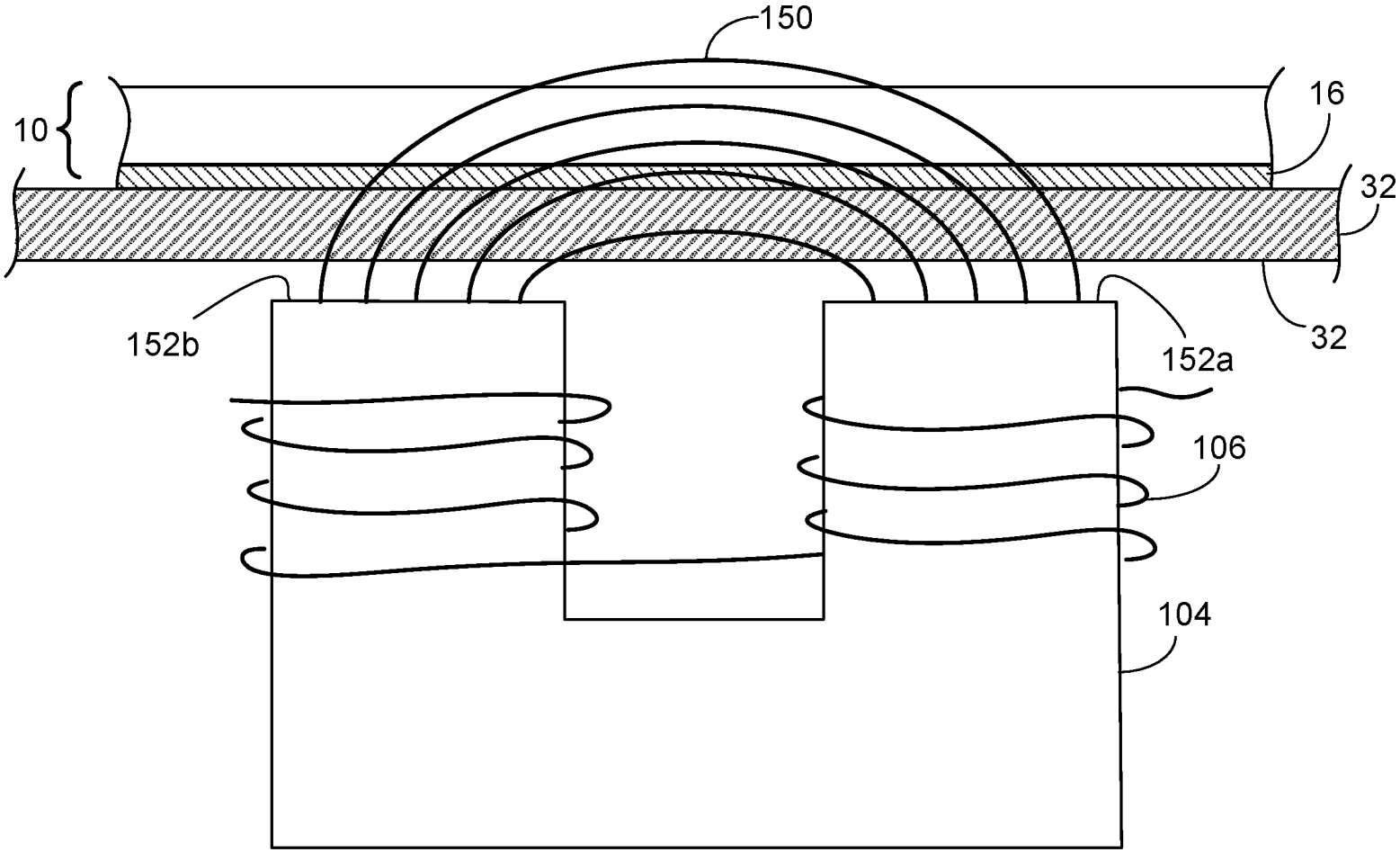
FIG. 3 is a schematic cross-sectional view illustrating a magnetic field generated by an eddy current monitoring system.

Referring to FIGS. 1 and 3, the drive and sense circuitry 108 applies an AC current to the coil 106, which generates a magnetic field 150 between two poles 152*a* and 152*b* of the core 104. In operation, when the substrate 10 intermittently overlies the sensor, a portion of the magnetic field 150 extends into the substrate 10. The circuitry 108 can include a capacitor connected in parallel with the coil 106. Together the coil 106 and the capacitor can form an LC resonant tank.

If monitoring of the thickness of a conductive layer on the substrate is desired, then when the magnetic field 150 reaches the conductive layer, the magnetic field 150 can pass through and generate a current (if the target is a loop) or create an eddy current (if the target is a sheet). This modifies the effective impedance the characteristic of the LC circuit.

The drive and sense circuitry 108 can include a marginal oscillator coupled to a combined drive/sense coil 106, and the output signal can be a current required to maintain the peak to peak amplitude of the sinusoidal oscillation at a constant value, e.g., as described in U.S. Pat. No. 7,112,960. Other configurations are possible for the coil 106 and/or drive and sense circuitry 108. For example, separate drive and sense coils could be wound around the core. The drive and sense circuitry 108 can apply current at a fixed frequency, and the signal from the drive and sense circuitry 108 can be the phase shift of the current in the sense coil relative to the drive coil, or an amplitude of the sensed current, e.g., as described in U.S. Pat. No. 6,975,107.

Figure 2:
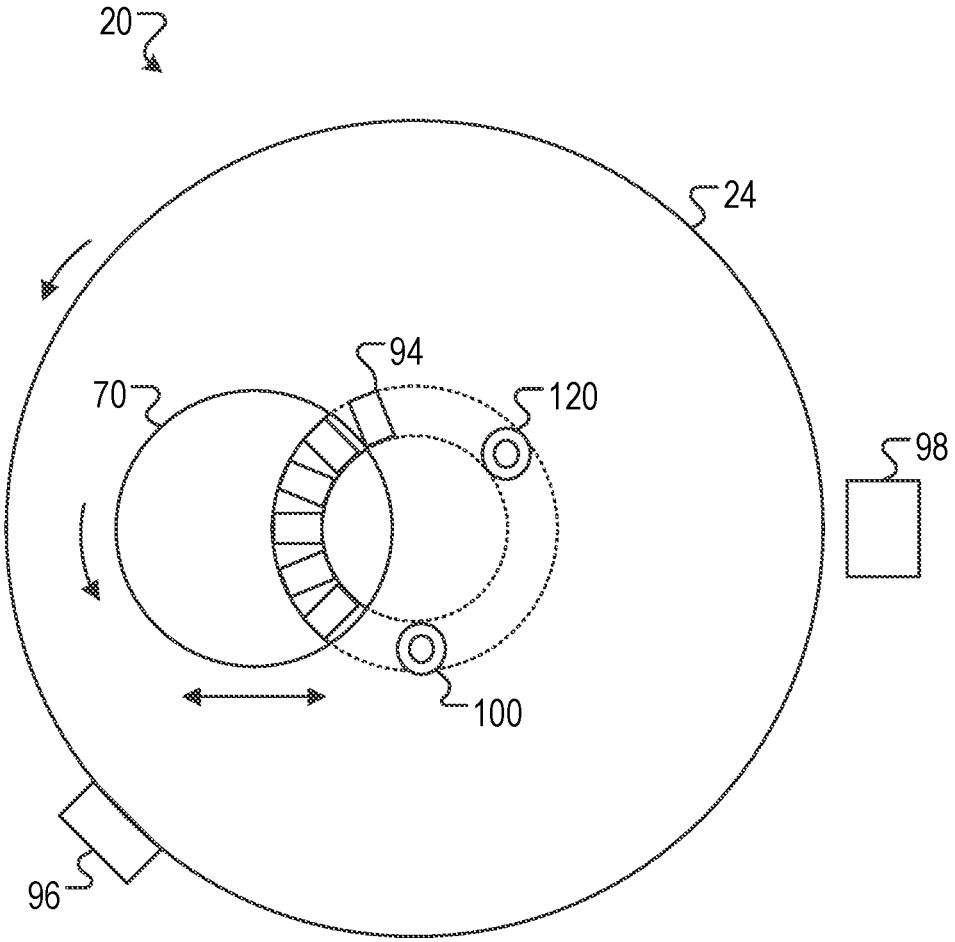
FIG. 2 is a schematic top view of the chemical mechanical polishing system of FIG. 1.

Referring to FIG. 2, as the platen 24 rotates, the sensor 102 sweeps below the substrate 10. By sampling the signal from the circuitry 108 at a particular frequency, the circuitry 108 generates measurements at a sequence of sampling zones 94 across the substrate 10. For each sweep, measurements at one or more of the sampling zones 94 can be selected or combined. For example, measurements from sampling zones within a particular radial zone can be averaged to provide a single measurement for each radial zone. As another example, a highest or lowest value within a particular radial zone can be selected to provide the measurement for the radial zone. Thus, over multiple sweeps, the selected or combined measurements provide the time-varying sequence of values.

Referring to FIGS. 1 and 2, the polishing system 20 can also include a position sensor to sense when the sensor is underneath the substrate 10 and when the sensor is off the substrate. For example, the position sensor can include an optical interrupter 98 mounted at a fixed location opposite the carrier head 70. A flag 96 can be attached to the periphery of the platen 24. The point of attachment and length of the flag 96 is selected so that it interrupts the light beam in the interrupter 98 while the sensor sweeps underneath the substrate 10. Alternately or in addition, the polishing system 20 can include an encoder to determine the angular position of the platen 24.

The controller 90 receives the signals from the sensor of the in-situ monitoring system 100. Since the sensor sweeps beneath the substrate 10 with each rotation of the platen 24, information on the depth of the conductive layer, e.g., the bulk layer or conductive material in the trenches, is accumulated in-situ (once per platen rotation). The controller 90 can be programmed to sample measurements from the in-situ monitoring system 100 when the substrate 10 generally overlies the sensor.

In addition, the controller 90 can be programmed to calculate the radial position of each measurement, and to sort the measurements into radial ranges. By arranging the measurements into radial ranges, the data on the conductive film thickness of each radial range can be fed into a controller (e.g., the controller 90) to adjust the polishing pressure profile applied by a carrier head. The controller 90 can also be programmed to apply endpoint detection logic to the sequence of measurements generated by the in-situ monitoring system 100 and detect a polishing endpoint. For example, the controller 90 can detect when the sequence of measurements reaches or crosses a threshold value.

Figure 4:
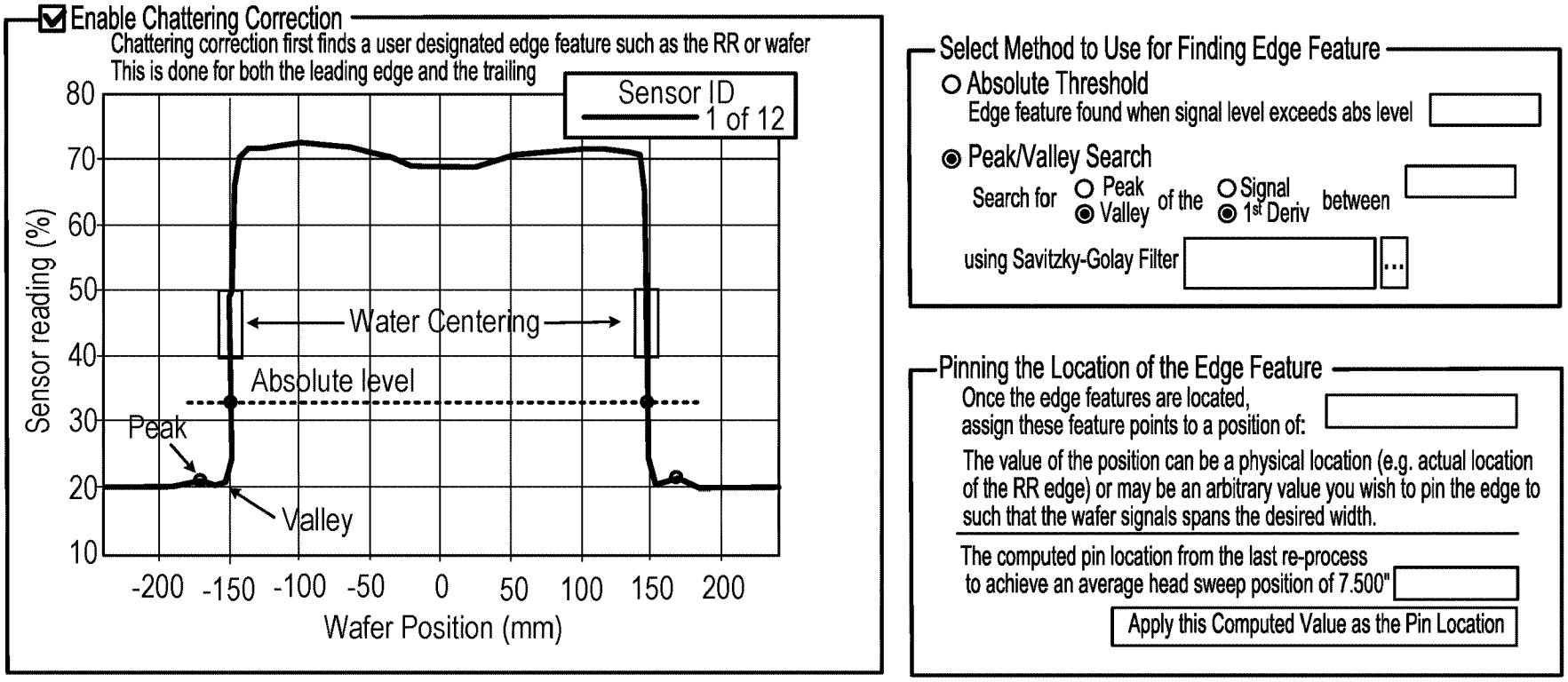
FIG. 4 includes a graph of a signal from the eddy current monitoring system as the core scans across the substrate, and illustrates a graphical user interface to be displayed by a controller.
Figure 5A:
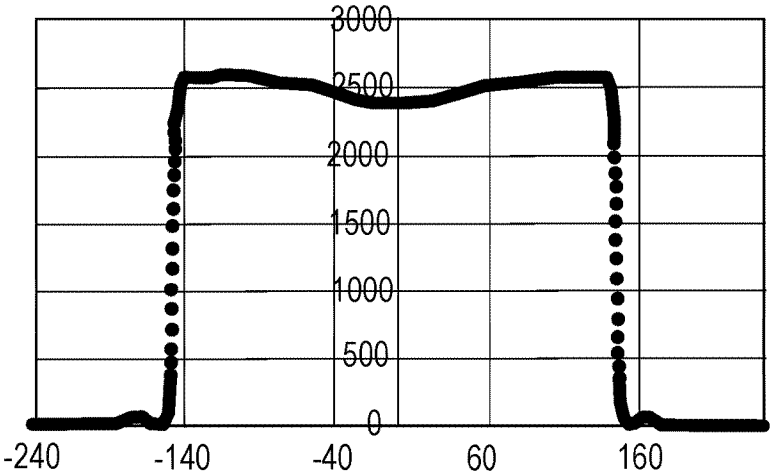
FIG. 5A illustrates a graph of a signal from the eddy current monitoring system as the core scans across the substrate.
Figure 5C:
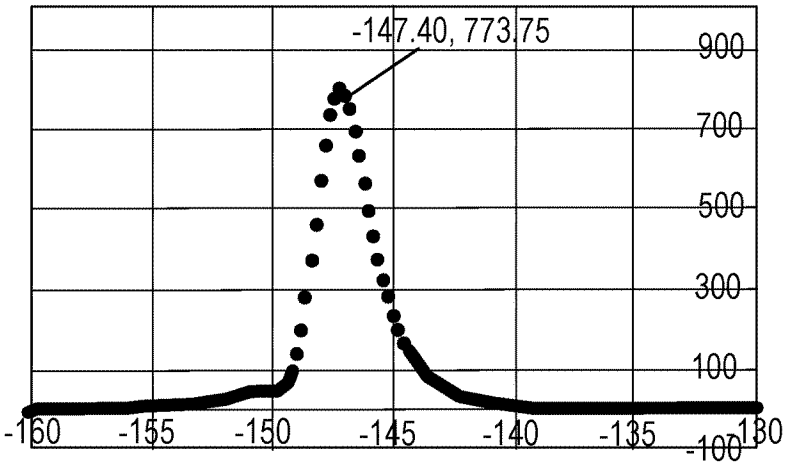
FIG. 5C illustrates an expanded view of the first derivative of a portion of the signal from the leading edge of the wafer.
Figure 5B:
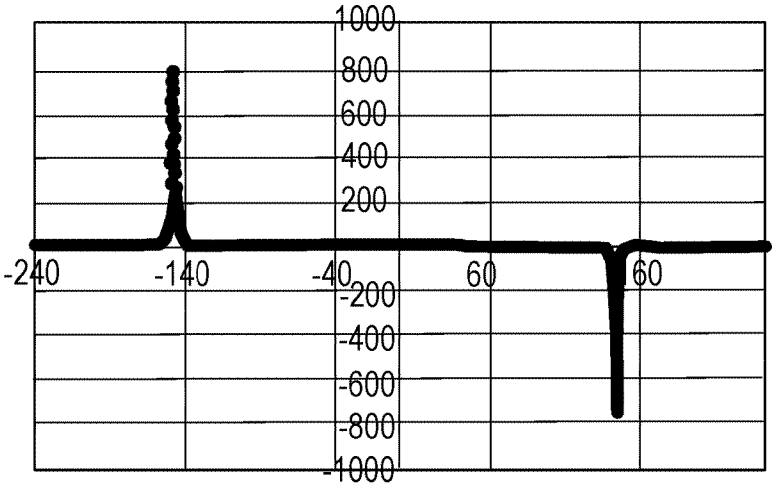
FIG. 5B illustrates a graph of the first derivative of the signal.
Figure 5D:
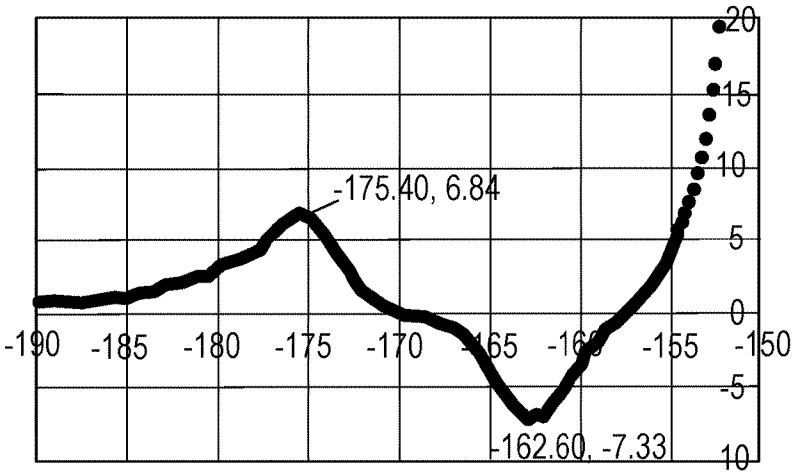
FIG. 5D illustrates an expanded view of the first derivative of a portion of the signal from the leading edge of the retaining ring.
Figure 5E:
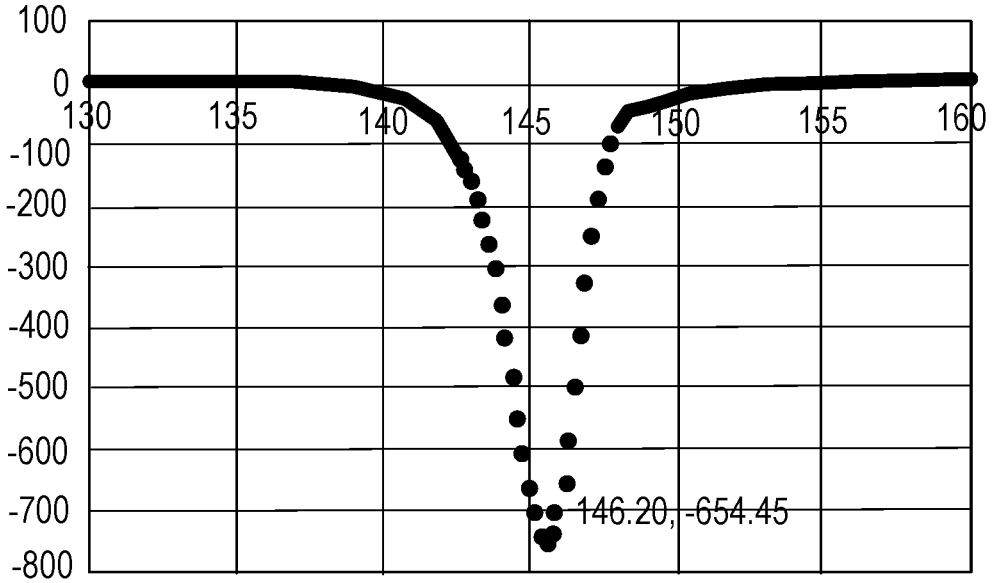
FIG. 5E illustrates an expanded view of the first derivative of a portion of the signal from the trailing edge of the wafer.
Figure 5F:
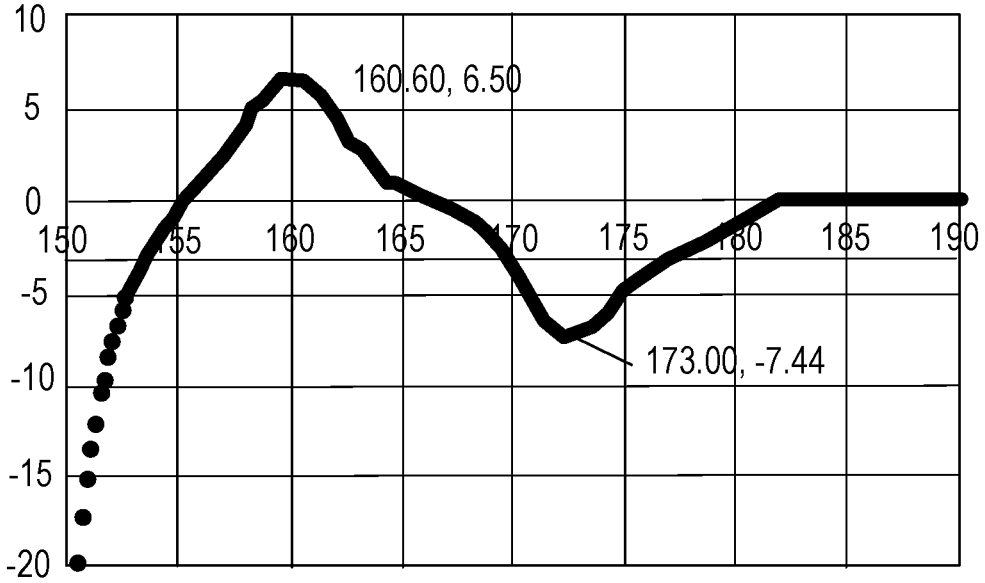
FIG. 5F illustrates an expanded view of the first derivative of a portion of the signal from the trailing edge of the retaining ring.

Referring to FIGS. 4-5, the signal from the in-situ monitoring system 100 can be monitored to detect a leading edge and a trailing edge of the substrate. Alternatively, the signal from the in-situ monitoring system 100 can be monitored to detect a leading edge and a trailing edge of the retaining ring, e.g., a leading edge and trailing edge of an inner surface 84*a* of the retaining ring 84, or a leading edge and trailing edge of an outer surface 84*b* of the retaining ring 84 (see FIG. 1).

To detect the leading edge and trailing edge, the first derivative of the signal can be calculated and monitored. For example, the first derivative of the signal can be calculated and monitored for a peak (for the leading edge of the substrate or outer surface of the retaining ring) and a valley (for the trailing edge of the substrate or outer surface of the retaining ring). As another example, the first derivative of the signal can be calculated and monitored for a valley (for the leading edge of the inner surface of the retaining ring) and a peak (for the trailing edge of the inner surface of the retaining ring). The time at which the peak and valley occur indicates the time that the sensor crosses the leading edge and trailing edge, respectively.

Figure 6:
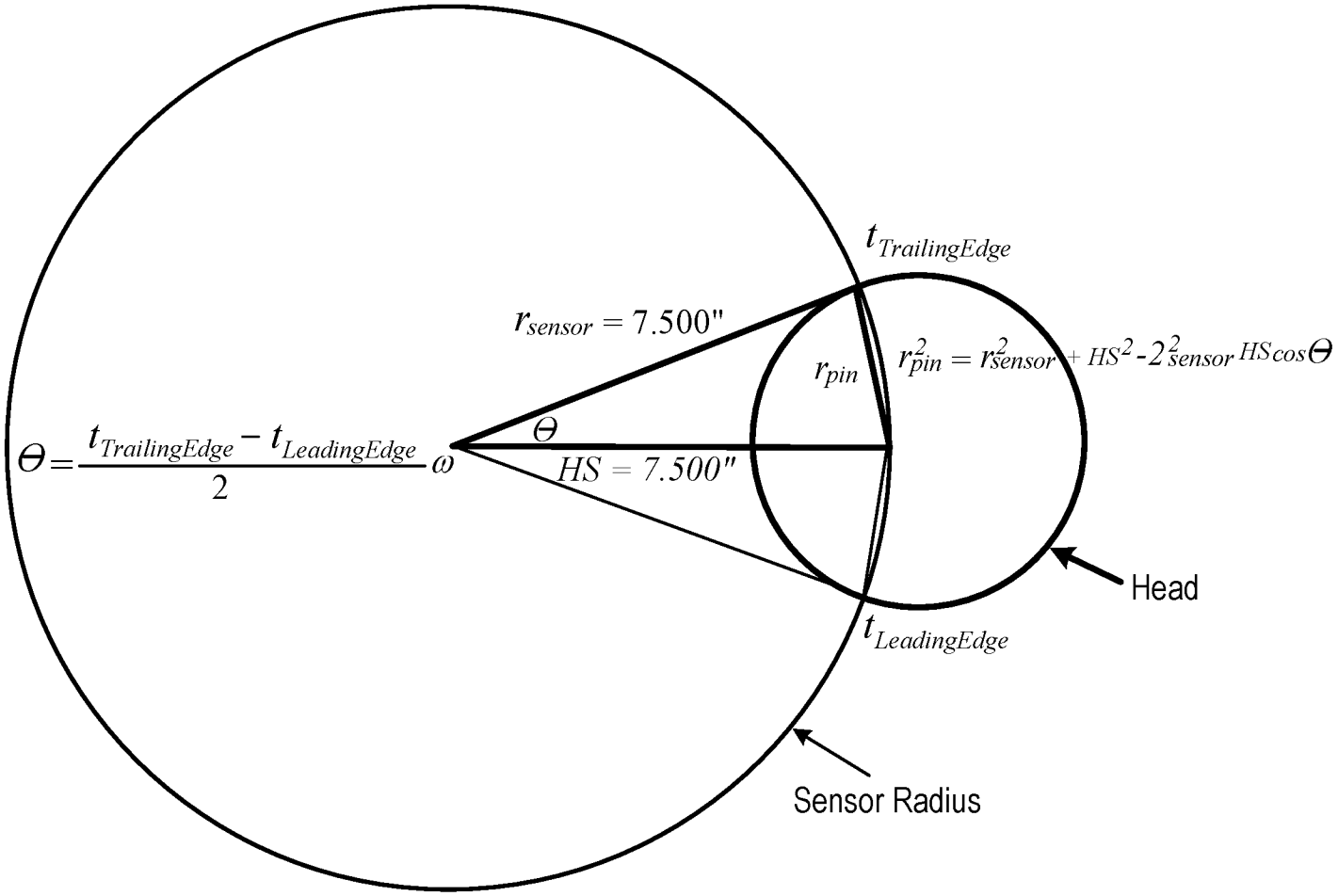
FIG. 6 is a schematic diagram illustrating the process for calculating a radial position of measurement.

To calculate the radial position of the measurements, the polishing system can initially be run in a calibration mode in which the carrier head 70 is not laterally oscillated. Referring to FIG. 6, in this calibration run, the carrier head is positioned such that the center of the carrier head 70 is at the same radial distance from the axis of rotation of the platen 24 as the sensor.

The controller 90 detects, based on the received signal from the eddy current monitoring system, the time $t_{LE}$ at which the sensor crosses a leading edge, and similarly detects the time $t_{TE}$ at which the sensor crosses a trailing edge, as discussed above.

The platen rotation rate, ω, can be calculated based on signals from the position sensor. Alternatively or in addition, ω is be taken from a control value stored in the controller.

Based on these values, a radial position $r_{pin}$ of a "pin point" can be calculated using the following equations:

$$\theta = \frac{t_{TE} - t_{LE}}{2}\omega \quad \text{(EQ. 1)}$$

$$r_{pin}^2 = HS^2 + r_{sensor}^2 - 2HSr_{sensor}\cos\theta \quad \text{(EQ. 2)}$$

where HS is the head sweep position (the distance between the axis of rotation of the platen 24 and the center axis 71 of the carrier head) and $r_{sensor}$ is a known distance between the sensor and the axis of rotation of the platen. Here the term "pin point" indicates a set point on the edge, e.g., the edge of the substrate or inner or outer surface of the retaining ring.

In subsequent monitoring steps, positions of measurements can be calculated based on the position of the pin point. If a retaining ring edge is being used as the pin point, the substrate can be absent during the calibration. An exemplary value for both HS and $r_{sensor}$ during the calibration run is 7.5 inches.

Figure 7:
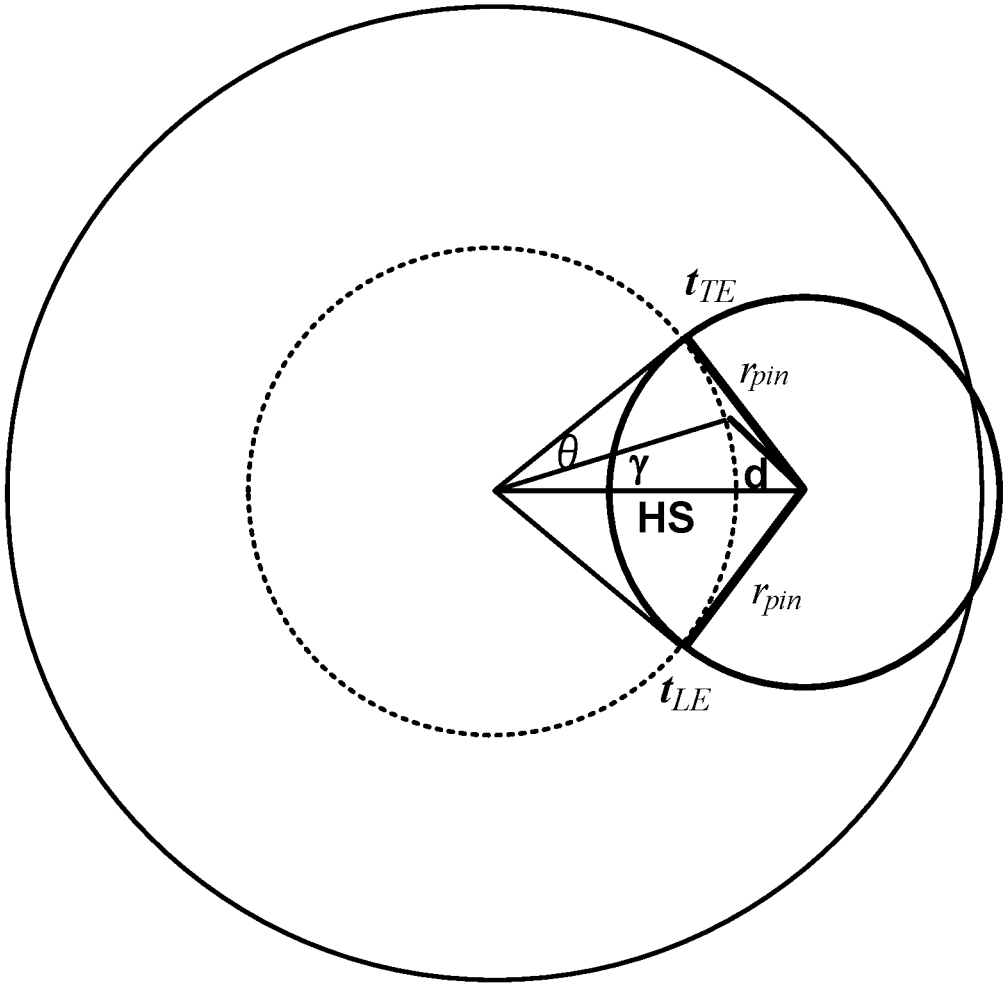
FIG. 7 is a schematic diagram illustrating calculation of the position of the measurement (in terms of radial distance from the center of the substrate).

Referring to FIG. 7, for polishing of substrates, the polishing system can initially be run in a normal mode in which the carrier head 70 does laterally oscillate and the substrate 10 is monitored with the in-situ monitoring system 100. In this mode, the head sweep position HS can be calculated on a sweep-by-sweep basis. That is, for each sweep, times $t_{LE}$ and $t_{TE}$ are determined based on the signal from the eddy current monitoring system. The head sweep position HS can be calculated from ω, $t_{LE}$, $t_{TE}$, $r_{pin}$ and $r_{sensor}$ using Equation 1 above and the following equations with a=1:

$$b = -2r_{sensor}\cos\theta \quad \text{(EQ. 3)}$$

$$c = r_{sensor}^2 - r_{pin}^2 \quad \text{(EQ. 4)}$$

$$HS = \frac{-b \pm \sqrt{b^2 - 4ac}}{2a}. \quad \text{(EQ. 5)}$$

The position of each measurement from the in-situ monitoring system, i.e., the radial distance d of the measurement from the center of the substrate, can then be calculated on a measurement-by-measurement basis from HS, ω, $t_{LE}$, $t_{TE}$, and $r_{sensor}$ and the particular time $t_{flash}$ at which the measurement occurs (real time) using the following equations:

$$\gamma = \left[t_{flash} - \frac{(t_{TE} - t_{LE})}{2}\right]\omega \quad \text{(EQ. 6)}$$

$$d^2 = HS^2 + r_{sensor}^2 - 2HSr_{sensor}\cos\gamma \quad \text{(EQ. 7).}$$

γ represents the angle between the sensor and the line connecting the center of the platen and the center of the carrier head at the time of the measurement. Again, the platen rotation rate, ω, can be calculated based on signals from the position sensor. Alternatively or additionally, ω can be taken from a control value stored in the controller.

By using a location of the pin point and geometrical calculation of the sensor location on the substrate, the actual locations (e.g., radial positions relative to the center of the substrate) of measurements can be determined more accurately, and consequently chattering can be reduced. This enables improved scan-to-scan and senor-to-sensor matching. As a result, endpoint determination can be made more reliable and/or wafer uniformity can be improved.

Embodiments can be implemented as one or more computer program products, i.e., one or more computer programs tangibly embodied in a non-transitory machine readable storage media, for execution by, or to control the operation of, data processing apparatus, e.g., a programmable processor, a computer, or multiple processors or computers.

The above described polishing apparatus and methods can be applied in a variety of polishing systems. The polishing layer can be a standard (for example, polyurethane with or without fillers) polishing material, a soft material, or a fixed-abrasive material. The technique for calculating the position of the measurements from the in-situ monitoring system can be applied to other types of monitoring systems, e.g., optical monitoring systems, so long as such monitoring systems are able to detect the substrate and/or retaining ring edge. Where terms of relative positioning are used, it should be understood that this refers to relative positioning of components within the system; the polishing surface and substrate can be held in a vertical orientation or some other orientation relative to gravity.

A number of embodiments of the invention have been described. Nevertheless, it will be understood that various modifications may be made without departing from the spirit and scope of the invention. Accordingly, other embodiments are within the scope of the following claims.

What is claimed is:

1. A computer program product, tangibly encoded on a non-transitory computer-readable media, comprising instructions to cause a computer system to:

receive, from a first sensor of an in-situ monitoring system that sweeps across and monitors a substrate during polishing, a sequence of signal values that depend on a thickness of a layer undergoing polishing on the substrate;

detect, from the sequence of signal values from the first sensor of the in-situ monitoring system, a time that the first sensor traverses a leading edge of the substrate or a retaining ring holding the substrate and a time that the first sensor traverses a trailing edge of the substrate or retaining ring; and for each signal value of at least some of the sequence of signal values, determine a position on the substrate for the signal value based on the time that the first sensor traverses the leading edge of the substrate or retaining ring and the time that the first sensor traverses a trailing edge of the substrate or retaining ring, wherein the instructions to determine the position of the signal value on the substrate include instructions to determine a distance of a center of a carrier head holding the substrate from an axis of rotation of a rotatable platen based on the time that the first sensor traverses the leading edge and the time that the first sensor traverses the trailing edge, and to determine the position on the substrate for the signal value based on the distance.

2. The computer program product of claim 1, wherein instructions to determine the position comprise instructions to determine a first derivative of the signal value; and identify a first extrema and a second extrema in the first derivative of the signal value, wherein the first extrema is indicative of the leading edge and the second extrema is indicative of the trailing edge.

3. The computer program product of claim 1, wherein instructions to determine the position comprise instructions to cause a carrier head to position a substrate such that the center of the carrier head is a same radial distance from an axis of rotation of the rotatable platen as the first sensor of the in-situ monitoring system;

detect the leading edge and the trailing edge with the first sensor;

determine a time that the leading edge and the trailing edge cross the first sensor;

determine a platen rotation rate based on signals from a second position sensor that is separate from the first sensor of the in-situ monitoring system; and determine a position of a pin point on the leading edge and the trailing edge relative to the center of the carrier head.

4. The computer program product of claim 1, wherein instructions to determine the position on the substrate for the signal value comprise instructions to calculate the position using a distance between a pin point where the first sensor passes below the edge of the substrate and a midpoint where the first sensor is equidistance from leading and trialing edges of the substrate.

5. The computer program product of claim 4, wherein instructions to determine the position on the substrate for the signal value comprise instructions to determine a position of the carrier head relative to a center of the platen using the distance between the pin point and the midpoint.

6. The computer program product of claim 5, wherein instructions to determine the position of the carrier head comprise instructions to calculate an angle Θ subtended by the edge in accordance with $$\theta = \frac{t_{TE} - t_{LE}}{2}\omega$$

where TLE is the time that the first sensor traverses the leading edge, TTE is the time that the first sensor traverses the trailing edge, and ω is a rotation rate of the platen.

7. The computer program product of claim 6, wherein instructions to determine the position of the carrier head relative to the center of the platen, HS, comprise instructions to calculate the position of the carrier head in accordance with $$HS = \frac{-b \pm \sqrt{b^2 - 4ac}}{2a},$$

with a=1, $$b=-r_{sensor}^{Cos\theta}, \text{ and}$$

$$c=r_{sensor}^{2},$$

where $r_{sensor}$ is a distance of the first sensor from the center of the platen and $r_{pin}$ is the distance between the pin point and the midpoint.

8. The computer program product of claim 7, wherein instructions to determine the position on the substrate for the signal value, d, comprise instructions to calculate the position on the substrate in accordance with $$d^2 = HS^2 + r_{sensor}^2 - 2HSr_{sensor}\cos\gamma,$$

with $$\gamma = \left[t_{flash} - \frac{(t_{TE} - t_{LE})}{2}\right]\omega$$

where $t_{flash}$ is a time at which the measurement of the signal value is made.

9. A method of polishing, comprising:

bringing a surface of a layer of a substrate into contact with a polishing pad;

causing relative motion between the substrate and the polishing pad;

sweeping a first sensor of an in-situ monitoring system across the substrate as the layer of the substrate undergoes polishing with a rotatable platen;

generating, from the in-situ monitoring system, a sequence of signal values that depend on a thickness of the layer;

detecting, from the sequence of signal values from the first sensor of the in-situ monitoring system, a time that the first sensor traverses a leading edge of the substrate or retaining ring and a time that the first sensor traverses a trailing edge of the substrate or retaining ring; and for each signal value of at least some of the sequence of signal values, determining a position on the substrate for the signal value based on the time that the first sensor traverses the leading edge of the substrate or retaining ring and the time that the first sensor traverses a trailing edge of the substrate or retaining ring, including determining a distance of a center of a carrier head holding the substrate from an axis of rotation of a rotatable platen based on the time that the first sensor traverses the leading edge and the time that the first sensor traverses the trailing edge, and determining the position on the substrate for the signal value based on the distance.

10. The method of polishing of claim 9, wherein detecting the sequence of signal values comprises detecting a leading edge and a trailing edge of the retaining ring.

11. The method of polishing of claim 10, wherein detecting a leading edge and a trailing edge of the retaining ring comprises detecting a leading edge and a trailing edge of an inner surface of the retaining ring.

12. The method of polishing of claim 9, wherein determining the position comprises:

determining a first derivative of the sequence of signal values; and identifying a valley and a peak in the first derivative, wherein the valley is indicative of the leading edge and the peak is indicative of the trailing edge.

13. The method of polishing of claim 9, wherein detecting the sequence of signal values comprises detecting a metallic layer within the leading edge and a trailing edge of the substrate.

14. The method of polishing of claim 13, wherein determining the position comprises:

determining a first derivative of the sequence of signal values; and identifying a peak and a valley, wherein the peak is indicative of the leading edge and the valley is indicative of the trailing edge.

15. The method of polishing of claim 9, wherein determining a position comprises:

positioning a carrier head retaining the substrate such that the center of the carrier head is the same radial distance from an axis of rotation of the rotatable platen as the first sensor;

detecting the leading edge and the trailing edge of the substrate with the first sensor;

determining a time that the leading edge and the trailing edge cross the first sensor;

determining a platen rotation rate based on signals from a second position sensor that is separate from the first sensor of the in-situ monitoring system; and determining a position of pin point on the edge.

16. The method of polishing of claim 15, wherein determining the position on the substrate for the signal value comprises calculating the position on the substrate using the position of the pin point.

17. A polishing system, comprising:

a rotatable platen to support a polishing pad;

a carrier head to hold a substrate against the polishing pad;

an in-situ monitoring system including a first sensor to sweep across the substrate during polishing and generate a sequence of signal values that depend on a thickness of a layer undergoing polishing; and a controller configured to:

receive the sequence of signal values from the first sensor, detect, from the sequence of signal values from the first sensor of the in-situ monitoring system, a time that the first sensor traverses a leading edge of the substrate and a time that the first sensor traverses a trailing edge of the substrate, and for each signal value of at least some of the sequence of signal values, determine a position on the substrate for the signal value based on the time that the first sensor traverses the leading edge of the substrate or retaining ring and the time that the first sensor traverses a trailing edge of the substrate or retaining ring by determining a distance of a center of a carrier head holding the substrate from an axis of rotation of a rotatable platen based on the time that the first sensor traverses the leading edge and the time that the first sensor traverses the trailing edge, and determining the position on the substrate for the signal value based on the distance.

18. The polishing system of claim 17, wherein the in-situ monitoring system comprises an eddy current monitoring system and the first sensor is positioned in a recess of the platen, the first sensor configured to generate a signal when a leading edge or a trailing edge of the substrate passes over the first sensor, and the eddy current monitoring system includes drive and sense circuitry electrically coupled to the first sensor and the controller; and the polishing system comprises a second position sensor that is separate from the first sensor, the second position sensor configured to sense a position of the rotatable platen.

19. The polishing system of claim 18, wherein the second position sensor comprises a radial encoder.

20. The polishing system of claim 19, wherein the radial encoder is coupled to a drive shaft of the rotatable platen.

21. The polishing system of claim 18, wherein the in-situ monitoring system comprises an eddy current monitoring system.

22. The polishing system of claim 18, wherein the in-situ monitoring system comprises an optical monitoring system.

* * * * *